United States Patent [19]

Vorobiev et al.

[11] 3,930,602

[45] Jan. 6, 1976

[54] APPARATUS FOR TRANSFERRING THREADS FROM THE SPINNING AND FINISHING PART OF A MACHINE FOR CONTINUOUS PRODUCTION OF ARTIFICIAL THREADS TO THE TAKE-UP AND WINDING ARRANGEMENT THEREOF

[76] Inventors: Alexandr Kupriyanovich Vorobiev, ulitsa Ushinskogo, 39, korpus 1, kv. 24; Vladimir Anatolievich Goldin, Moskovsky prospekt, 195, kv. 157; Adolf Sergeevich Severin, Lesnoi prospekt, 37, korpus 5, kv. 525; Ljudmila Sergeevna Scherbakova, prospekt Kosmonavtov, 27, korpus 2, kv. 104, all of Leningrad; Nikolai Alexandrovich Orlov, prospekt Vernadskogo, 9/10, kv. 105, Moscow; Vsevolod Grigorievich Novitsky, Mosfilmovskaya ulitsa, 25, kv. 41, Moscow; Oleg Vladimirovich Tryaskin, ulitsa Stalevarov, 8/22, korpus 4, kv. 455, Moscow; Dmitry Pavlovich Olenin, Sumskoi proezd, 12, korpus 2, kv. 570, Moscow; Valery Iosifovich Nesvizhsky, prospekt Mira, 129, kv. 27, Moscow; Evsei Moiseevich Mogilevsky, Kutuzovsky prospekt, 17, kv. 9, Moscow; Igor Petrovich Baksheev, proezd Shokalskogo, 53, kv. 140, Moscow; Georgy Georgievich Finger, ulitsa Matveevskaya, 4, korpus 2, kv. 21, Moscow; Ivan Gavrilovich Shimko, ulitsa Kominterna, 13/4, kv. 24, Moscow; Gleb Alexandrovich Golubev, prospekt M.Toreza, 9, kv. 116, Leningrad, all of U.S.S.R.

[22] Filed: Oct. 4, 1974

[21] Appl. No.: 512,329

[52] U.S. Cl. ..... 226/91; 28/1.4; 226/97; 226/109

[51] Int. Cl.[2] ..... B65H 17/32

[58] Field of Search ..... 226/97, 91, 109, 7; 28/1.4

[56] References Cited

UNITED STATES PATENTS

| | | | |
|---|---|---|---|
| 2,563,986 | 8/1951 | Bauer | 226/97 X |
| 3,729,831 | 5/1973 | Kosaka et al. | 28/1.4 X |

*Primary Examiner*—James B. Marbert
*Assistant Examiner*—Bruce H. Stoner, Jr.
*Attorney, Agent, or Firm*—Steinberg & Blake

[57] ABSTRACT

An apparatus for transferring threads from the spinning-cum-finishing part of a machine for continuous production of artificial threads to the take-up and winding arrangement thereof includes thread guiding tubes with thread guides for centering the thread along the axis of the tube and an ejector nozzle for feeding a stream of air together with the thread into each respective tube. The thread guide situated at the exit end of the tube includes a cup-shaped member with an aperture made through the center of the bottom thereof and a port made in the side wall of the member, communicating with the aperture. There is mounted adjacent to the cup-shaped member, in opposition to the port thereof, a screen for slowing down the air stream issuing from the tube together with the thread. This structure prevents misdirecting of the thread to the nearby parts and stations of the take-up and winding arrangement.

7 Claims, 19 Drawing Figures

APPARATUS FOR TRANSFERRING THREADS FROM THE SPINNING AND FINISHING PART OF A MACHINE FOR CONTINUOUS PRODUCTION OF ARTIFICIAL THREADS TO THE TAKE-UP AND WINDING ARRANGEMENT THEREOF

The present invention relates to machines for continuous production of artificial threads, such as rayon threads, and, more particularly, it relates to arrangements for transferring threads from the spinning-cum-finishing part of such a machine to the take-up and winding arrangement thereof.

The herein disclosed apparatus can be advantageously used for transferring various kinds of man-made, synthetic as well as natural threads.

Every machine for continuous production of artificial threads is made up of two major parts, namely, the spinning-cum-finishing part wherein shaping, finishing and drying of the thread is performed and the take-up and winding part wherein the threads are wound into packages.

At present, in order to step-up the productivity of such machines, to improve the quality of threads and to increase the weight of the packages the take-up and winding arrangements of such machines are separated from the spinning-cum-finishing parts thereof and arranged alongside of the latter, either on the same floor or on different floors, in the same room or in separate rooms.

With the take-up and winding arrangement of the machine being remote from the spinning-cum-finishing part thereof, favorable conditions are provided for stepping up the productivity of the machine as a whole by increasing the number of the spinning stations without increasing the overall length thereof; furthermore, in this way it becomes possible to seal away completely the spinning-cum-finishing part and thus to diminish considerably the amount of heat and gases released into the production premises accommodating the machine, to increase the weight of the packages wound in the take-up and winding arrangement by increasing the dimensions (i.e. the length and diameter) of the packages, to create optimal environmental conditions both for the spinning-cum-finishing part and for the take-up and winding arrangement and thus to improve the quality of the thread being produced.

In machines of the above-described kind, the continuously shaped threads are to be conveyed or transferred from the spinning-cum-finishing part to the take-up and winding arrangement spaced from this part. To attain this, there are employed apparatus comprising tubes associated with thread guides centering each thread along the axis of the respective tube.

At present, there is known a machine for continuous production of artificial (e.g. rayon) thread, (cf. USSR Inventor's Certificate No 200,712, Nat. Cl. 29*a*, 6/07) wherein there is employed an apparatus for transferring a thread from the spinning-cum-finishing part to the take-up and winding arrangement. The apparatus includes bent thread guiding tubes with thread guides situated at the inlet and outlet of each tube, as well as at the bends of the tubes to effect centering of the thread along the axis of the tube. Furthermore, each tube is associated with an ejector nozzle for creating a flow of air within the tube, as the thread is guided into the latter, the spacing between the tubes being relatively small.

In this known apparatus, the thread guides are in the form of rings, the thread guide positioned at the outlet of the tube having an aperture of which the thread passage area should be practically as great as the passage area of the tube itself, to provide for free exit of the thread from the tube. However, with the size of the apertures of the thread guides being that great, it becomes virtually impossible to center the thread accurately along the axis of the tube and thus to positively prevent friction between the moving thread and the walls of the tube.

Besides, the motion of the air, created by the ejector nozzle at threading-in of the thread, is directed along the axis of the tube, and, as the air leaves the tube, it continues to flow in the same direction and thus continuously influences the end of the thread that has been propelled by this air from the outlet of the tube, entangling the elementary fibres in the thread and hampering subsequent threading-in of the thread into the take-up and winding arrangement. Such motion of the thread after it has been guided into the tube does not preclude a situation where the end of the thread finds its way to the nearby packages of the take-up and winding arrangement. This, in turn, results in breakage of the thread or in poorly wound packages. The eventuality of a thread finding its way to nearby packages is further promoted by the close spacing of the outlets of the tubes, which is determined by the spacing of the spinning stations, which, in order to step up the productivity of the machine and to save production space, is preferably as small as possible.

It is an object of the present invention to eliminate the above shortcomings.

It is another object of the present invention to provide an apparatus for transferring threads from the spinning-and-finishing part of a machine for continuous production of artificial threads to the take-up and winding arrangement thereof, wherein there should be prevented an eventuality of a thread finding its way to the nearby packages, with relatively close spacing between the outlet ends of the tubes being maintained.

Yet another object of the present invention is to provide an apparatus for transferring threads from the spinning-and-finishing-part of a machine for continuous production of artificial threads to the take-up and winding arrangement thereof, which should have the outlet ends of the tubes associated with thread guides of a shape positively preventing friction between the thread and the walls of the respective tube, thus providing for considerably improved quality of the threads being wound.

These and other objects are attained in an apparatus for transferring threads from theh spinning-and-finishing part of a machine for continuous production of artificial threads to the take-up and winding arrangement thereof, comprising thread guiding tubes with thread guides for centering individual respective threads along the axes of respective tubes and an ejector nozzle for feeding a jet of air together with the thread into each tube, in which apparatus, in accordance with the invention, each thread guide situated on the exit end of the tube includes a cup-shaped member with an aperture made through the centre of the bottom thereof and a port made through the side wall thereof, the port being of a greater size than the aperture and communicating therewith, there being provided, adjacent to each cup-shaped member in opposition to the port thereof, a screen for separation of the threads and for slowing down the jet of air issuing from the tube together with the thread.

With the thread guide being in the form of a cup-shaped member with an aperture through the centre of the bottom thereof, the thread is reliably centered along the axis of the tube and its rubbing against the walls of the tube is prevented; furthermore, the motion of the air issuing through the port in the side wall of the cup-shaped member is re-directed.

In other words, the jet of air moving together with the thread freely exits through the port and thus changes its direction, i.e. it moves on at an angle to the axis of the tube. Since the port of the cup-shaped member communicates with the aperture, the thread being guided into the take-up and winding arrangement bends and freely slides along the edge of the port toward the central aperture in the bottom of the cup-shaped member, owing to the take-up and winding arrangement being offset relative to the axis of the tube. In this way, the operation of threading-in of the thread is considerably simplified: first, the end of the thread extending from the tube is not influenced by the air which latter issues through the port sideways of the thread; second, the thread being threaded-in into the take-up and winding arrangement finds its way itself, without any external influence, to the central aperture in the bottom of the cup-shaped member and thus centres itself with respect to the axis of the tube.

With the abovementioned screen being positioned adjacent to the cup-shaped member in opposition to the port thereof, the motion of the issuing air is slowed down, the adjacent threads being reliably separated from one another and the possibility of the thread finding its way to the nearby packages of the take-up and winding arrangement being positively prevented, since each thread is bound to engage the screen corresponding to the port of the respective cup-shaped member. In this way, it becomes possible to maintain close spacing between the outlet ends of the tubes.

The invention is further characterized by that the aperture through the bottom of the cup-shaped member has a diameter which is smaller than the diameter of the thread guiding tube. This relationship between the diameters of the aperture in the cup-shaped member and the tube provides for positively precluding rubbing of the thread against the walls of the tube.

The invention is still further characterized by that the cup-shaped members are arranged on the respective thread guiding tubes so that the ports of the adjacent cup-shaped members are oriented in diametrally opposite directions, the screens being formed by a partition successively curving about all the cup-shaped members adjacent to their respective ports.

With the cup-shaped members being arranged in the above manner and with the screen being of the above structure, it becomes possible to arrange the packages of the take-up and winding arrangement in a staggered fashion in two parallel rows. This provides for mounting the tubes with close spacing therebetween.

The invention is further yet characterized by that a tray is provided to underlie the screens and the cup-shaped members. It is expedient that this tray should be air-permeable. As a thread is being threaded-in, the end thereof engages this tray, which prevents the eventuality of the thread getting accidentally directly into the take-up and winding arrangement; furthermore, getting hold of the thread to be guided into the take-up and winding arrangement is facilitated. The broken-away ends of the threads accumulate in this tray, whereby fouling of the take-up and winding arrangement is precluded.

The invention is also characterized by that the screen is of an arcuate shape and is mounted adjacent to the cup-shaped member to envelope the latter at the side of the port and at the side of the bottom.

The above arrangement of the screen results in the latter additionally performing the functions of the above-mentioned tray, which considerably simplifies the structure of the apparatus and facilitates threading-in of the thread.

It is expedient that the screen should be air-permeable. In this case, the air issuing together with the thread from the tube through the port of the cup-shaped member freely passes through the screen, whereas the thread either remains on the screen or slides therealong and unobstructedly falls into the tray.

Thus, the herein disclosed apparatus for transferring threads from the spinning-and-finishing part of a machine for continuous production of artificial threads to the take-up and winding arrangement thereof ensures reliable centering of a thread along the axis of the respective thread guiding tube, prevents rubbing of the thread against the walls of this tube and positively precludes access of the end of the thread to the nearby packages of the take-up and winding arrangement. The apparatus is of a simple structure and enhances the productivity of the machine.

The invention will be further described in connection with an embodiment of an apparatus for transferring threads from the spinning-and-finishing part of a machine for continuous production of artificial threads to the take-up and winding arrangement thereof, with reference being had to the accompanying drawings, wherein.

Figure 1:
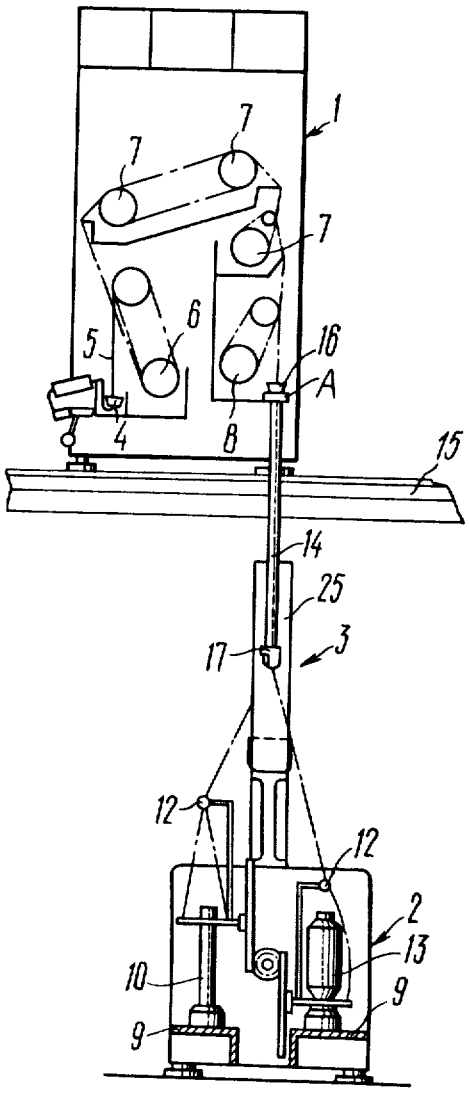
FIG. 1 shows schematically the layout of a machine for continuous production of artificial twisted threads, incorportating an apparatus embodying the invention.
Figure 10:
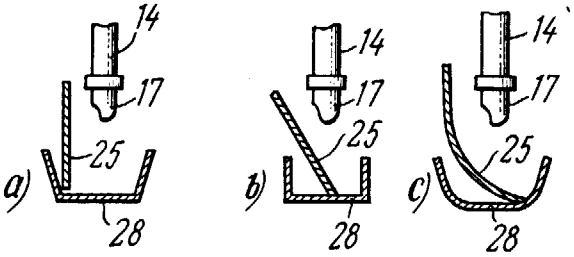
Figure 9:
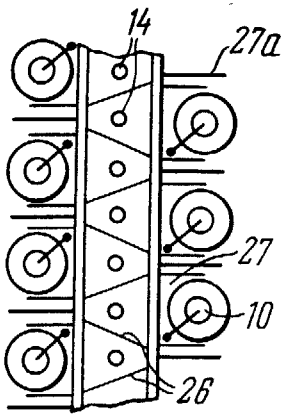

FIG. 7*a*, *b*, *c*, *d* shows various modifications of the screens arranged adjacent to the cup-shaped members;

FIG. 8*a*, *b*, *c*, *d* shows different shapes and arrangements of the screens adjoining the cup-shaped members;

FIG. 9 is a plan view of the take-up and winding arrangement illustrated in FIG. 1;

FIGS. 10*a*, *b*, *c* and 11 illustrate various ways of arranging the screens adjacent to the cup-shaped members.

Referring now in particular to the appended drawings, the known machine for continuous production of artificial threads includes a spinning-cum-finishing part 1 (FIG. 1) and a take-up and winding arrangement 2 situated, as is shown, in separate rooms and interconnected through an apparatus 3 for transferring the thread.

The spinning-cum-finishing part 1 of the machine includes the following known assemblies arranged in a sequential order reflecting the technology of the processing of the thread: a series of extrusion nozzles 4, each mounted in a trough with a setting solution wherein threads 5 are shaped from a viscose solution forced through the respective extrusion nozzles 4; cylinders 6 about which the respective threads 5 are finally shaped; cylinders 7 about which the threads 5 are finished; cylinders 8 about which the threads are dried.

The take-up and winding arrangement 2 includes a frame 9 on which spindles 10 for twisting the threads and winding them into packages are arranged in a staggered fashion in two parallel rows; alternatively, the frame 9 may house bobbins 11 (FIGS. 2 and 3) in case of production of intwisted threads, the number of either the spindles 10 or of the bobbins 11 equalling that of the extrusion nozzles 4.

The frame 9 (FIG. 1) further supports thereon a ring spinning and thread traversing mechanism with thread guides 12 arranged at respective spindles 10.

Figure 2:
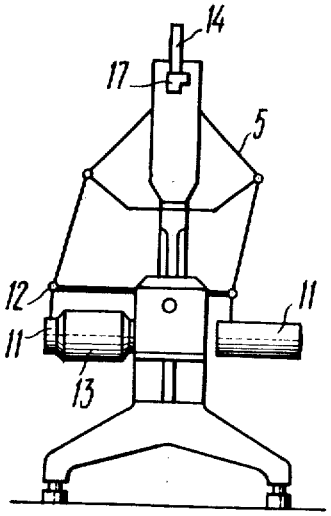
FIG. 2 illustrates one of the embodiments of the take-up and winding arrangement of a machine for production of untwisted threads.
Figure 3:
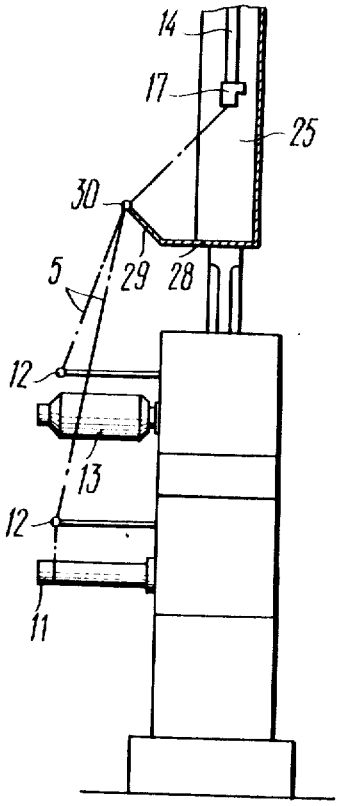
FIG. 3 shows another embodiment of the take-up and winding arrangement of a machine for production of a untwisted threads.

The spindles 10 are arranged vertically on either side of the frame 9, providing for two servicing sides of the machine, which enables to make the latter more compact. The bobbins 11 (FIGS. 2 and 3) may be arranged on the frame 9 either on either side thereof in a horizontal plane, as is shown in FIG. 2, or on one side of the frame, as is illustrated in FIG. 3.

On the spindles 10 or bobbins 11, there are mounted cores on which the threads are wound into packages 13.

The apparatus 3 (FIG. 1) for transferring the threads includes thread guiding tubes 14 extending through a partition 15 separating the rooms accommodating, respectively, the take-up and winding arrangement 2 and the spinning-cum-finishing part 1 of the machine from each other.

The number of the tubes 14 equals the number of the spinning stations of the machine, i.e. that of the extrusion nozzles 4.

To facilitate servicing of the machine, the bobbins 11 or spindles 10 of the take-up and winding arrangement 2 are offset with respect to the axes of respective tubes 14, as can be seen from FIGS. 1 to 3.

The inlet end of each tube 14 adjoins respective cylinders 8, while the outlet end thereof adjoins the take-up and winding arrangement 2.

The inlet end of the tube 14 carries an ejector nozzle 16 intended to create a flow of air through the tube when the thread 5 is to be threaded into the latter.

To preclude friction between the thread 5 and the walls of the tube 14, i.e. to preclude rubbing of the thread 5 against the walls of the tube, as the thread is moving through the tube toward the winding station, the tubes 14 have thread guides A mounted therein. These thread guides A are mounted both at the ends of the tubes and at other points along their lengths, the exact number and location of the thread guides A per tube being determined by the length and shape of the latter; thus, when the tube 14 is straight and vertical, it is sufficient to mount the thread guides at the inlet and outlet of the tube; should the tube 14 be U-shaped (this modification is not shown in the drawings), the thread guides are also mounted at the bends of the tube, etc. The thread guides A mounted at the inlets of the tubes 14 and at other points along their lengths are of the known shape, i.e. are shaped as rings (not shown in detail in the drawings), whereas the guides mounted at the outlets or exits of the tubes are shaped as cups 17.

Figure 4:
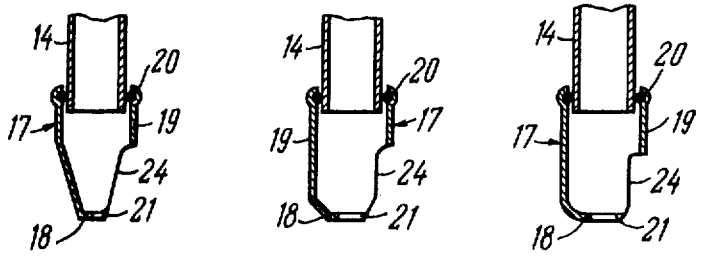
FIG. 4 represents longitudinally sectional views of cup-shaped members of various shapes.

These cup-shaped members or cups 17 may have different shapes, as is illustrated in FIG. 4, provided each one of them has a bottom 18 merging with a closed side wall 19. The cup 17 is received on the outlet end of a respective tube 14 and is secured thereon in a suitable known manner, e.g. with a resilient ring 20 accommodated within a corresponding groove provided in the internal side of the wall 19.

Figure 6:
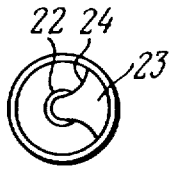
FIG. 6 shows a cup-shaped member viewed from below.

The bottom 18 of the cup 17 has an aperture 21 made therein coaxially with the tube 14, the diameter of this aperture 21 being substantially smaller than that of the tube 14, which provides for guiding the thread 5 clear of the walls of the tube 14. The cups 17 are preferably made of a material resistant to rubbing and featuring a small friction factor, such as, for instance, porcelain, mineral ceramics, etc. However, the cups 17 can be made of two different materials, e.g. of either kapron or organic glass of which the body of the cup is made and of either porcelain or mineral ceramics made whereof is a split ring 22 (FIG. 6) mounted centrally of the bottom 18 of the cup 17 and defining the aperture 21.

Figure 5:
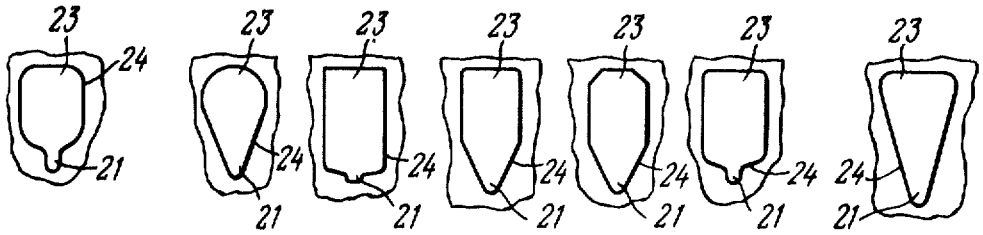
FIG. 5 shows various shapes of the ports of the cup-shaped members and various shapes of the lines along which the ports merge with the apertures of the cup-shaped members.

The side wall 19 of the cup has made therethrough a port 23 of a greater size than the aperture 21. This port 23 communicates with the aperture 21, the lines 24 along which the port 23 merges with the aperture 21 being gently curving ones. The port 23 can be of different shapes illustrated in FIG. 5 and, consequently, the lines 24 of merging of these ports with the aperture 21 are of different shapes.

Figure 7:
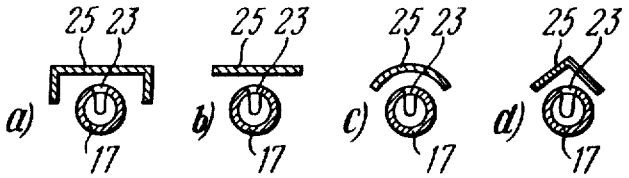

There is mounted, adjacent to each cup 17 in opposition to the port 23, a screen 25 (FIG. 7) intended to separate the adjacent threads and to slow down the jet of air issuing from the tube together with the thread through the port 23. The screens 25 may be of different shapes, e.g. rectilinear (FIG. 7*b*), arcuate (FIG. 7*c*), yoke-shaped (FIG. 7*a*), or else in the form of a V-shaped plate, as is shown in FIG. 7*d*. The above shapes of the screen 25 are advisable when the cups 17 have their ports 23 oriented in the same direction.

Figure 8:
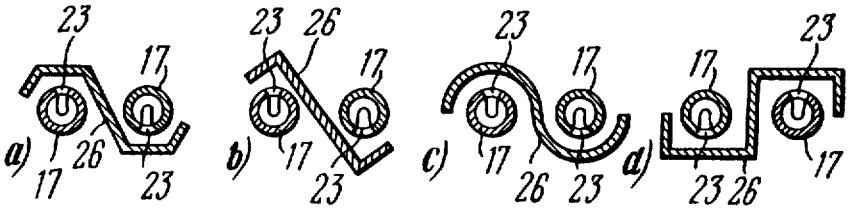

When the exit ends of the tubes 14 are spaced closely and when two parallel servicing zones are provided, the cups 17 are preferably mounted on the tubes 14 so that the ports 23 of each adjacent pair of the cups 17 are oriented in diametrally opposite directions, and the screens 25 associated with all the cups are made as a single partition 26 (FIG. 8) successively enveloping all the cups 17 of the respective tubes at the sides of their ports 23. As is illustrated in FIGS. 8*a*, *b*, *c*, *d* and 9, the shapes of such partitions may widely differ.

Thus, there is formed, adjacent to each tube 14, a free space 27 (FIG. 9) defined by the partition 26, the spindle 10 being situated in opposition to this space. This permits of arranging the spindles 10 or bobbins 11, in a staggered fashion, as can be seen from FIG. 9, another partition 27*a* separating either the spindles 10 or the bobbins 11 from one another to prevent a thread finding its way to a wrong nearby bobbin or spindle.

Positioned to underlie the screens 25 (FIG. 3) and cups 17 is a tray 28 into which the end of the thread 5 passes after it has left the outlet of the tube 14. The tray 28 may be provided with side walls 29, in which case these side walls 29 have additional thread guides 30 mounted thereon to preclude rubbing of the thread against these side walls.

Figure 11:
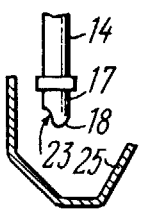

Both the trays 28 and screens 25 are preferably air-permeable, e.g. they can be made of such known structural materials as perforated sheets, wire gauze, fabric. The screen 25 may be mounted normal to the tray 28 (FIG. 10*a*), or at an angle thereto (FIG. 10*b*), or it can follow an arc (FIG. 10*c*). Alternatively, the screen 25 can be of an arcuate shape, as is shown in FIG. 11 and it can be mounted adjacent to the cup 17 to envelope the latter on the side of the port 23 and of the bottom 28, i.e. the screen may be made integral with the tray. In this case, the screen 25 additionally performs the function of the tray 28, i.e. it serves as a means for separating the adjacent threads from each other and for collection of the ends of these threads.

The herein disclosed apparatus operates as follows.

A viscose solution of which the thread is shaped (FIG. 5) is forced through each one of the extrusion nozzles into the setting solution, in which way the threads 5 are shaped and directed onto the cylinders 6 for final shaping. Thereafter, the threads are finished about the cylinders 7 and dried about the cylinders 8. Therefrom, the threads 5 are threaded into the ejector nozzles 16 of the respective tubes 14 and driven by compressed air through these tubes toward either the respective spindles 10 or the respective bobbins 11 (FIGS. 2 and 3) of the take-up and winding mechanism 2. The action of the moving air propels each thread 5 from the tube 14 through the port 23 in the wall of the cup 17, from which the thread 5 is carried by this moving air toward the screen 25. If the screen is made as a solid sheet, the thread recoils from this screen 25 and falls into the tray 28, while the issuing air jet has its speed reduced, i.e. it slows down, which prevents the influence of this jet of air upon the thread 5 within the free space 27 adjacent to the cup 17.

If the screen 25 and the tray 28 are air-permeable, the thread that has been propelled from the port 23 engages the screen 25 and moves unperturbed into the tray 28, while the air unobstructedly passes either through the screen or through the tray or both without exerting any further action on the thread.

Then the thread 5 is taken from the tray 28 and threaded through the thread guides or eyelets 30, 12 (FIG. 3) onto either the bobbins 11 or spindles 10. The latter being offset with respect to the axis of the tube 14, the thread 5 becomes bent and slides along the edge of the port 23 and the lines 24 of merging of the port 23 with the aperture 21, in which way it finds its way into this aperture 21 of the cup 17 and thus is centered in the thread guiding tube 14, which precludes rubbing of the thread against the walls of this tube. After the thread has been threaded into the take-up and winding mechanism, the supply of compressed air into the ejector 16 is cut off.

What we claim is:

1. An apparatus for transferring threads from the spinning-and-finishing part of a machine for continuous production of artificial threads to the take-up and winding arrangement thereof, comprising: a plurality of thread guiding tubes each having the inlet end thereof situated adjacent to said spinning and finishing part and having the outlet end thereof situated adjacent to said take-up and winding arrangement; a plurality of thread guides mounted on said ends of said tubes and adapted to center individual threads along the axes of respective tubes; an ejector means mounted on said inlet end of each said tube and adapted to feed respective threads into said tube by directing a stream of air toward said outlet end thereof; each of said thread guides mounted on said outlet ends of said tubes including a cup-shaped member having a bottom and a side wall; an aperture made in the center of said bottom of each said cup-shaped member; a port made in said side wall of each said cup-shaped member, having a size greater than that of said aperture and communicating therewith; a screen means mounted adjacent to said cup-shaped member of each said tube in opposition to said port thereof and adapted to separate the adjacent ones of said threads and to slow down the jet of air issuing from said tube together with a respective thread, as the latter is being fed through said tube.

2. An apparatus as claimed in claim 1, wherein said aperture in said bottom of said cup-shaped member has a diameter smaller than the diameter of said thread guiding tube.

3. An apparatus as claimed in claim 1, wherein said cup-shaped members are arranged on respective tubes so that said ports of the adjacent ones of said cup-shaped members are oriented in diametrally opposing directions, said screen means being made in the form of a partition successively enveloping said cup-shaped members on the side of said ports thereof.

4. An apparatus as claimed in claim 3, wherein a tray is provided to underlie said screen means and said cup-shaped members.

5. An apparatus as claimed in claim 4, wherein said tray is air-permeable.

6. An apparatus as claimed in claim 1, wherein said screen means is of an arcuate shape and is mounted next to said cup-shaped member to envelope the latter on the side of said port thereof and on the side of said aperture thereof.

7. An apparatus as claimed in claim 1, wherein said screen means is air-permeable.

* * * * *